US005700971A

United States Patent [19]

Rayer et al.

[11] Patent Number: 5,700,971

[45] Date of Patent: Dec. 23, 1997

[54] RAPID-RELEASE SMOKE HAND GRENADE

[75] Inventors: Peter Rayer, Neuenburg; Norbert Wardecki, Heuweiler; Karl Raupp, Neuenburg, all of Germany

[73] Assignee: Buck Werke GmbH & Co., Bad Uberkingen, Germany

[21] Appl. No.: 768,898

[22] Filed: Dec. 17, 1996

[30] Foreign Application Priority Data

Dec. 22, 1995 [DE] Germany ..... 195 48 436.3

[51] Int. Cl.[6] ..... F42B 27/00; F42B 12/48

[52] U.S. Cl. ..... 102/334; 102/335; 102/368; 102/482; 102/486

[58] Field of Search ..... 102/334–336, 102/368, 482, 486, 487, 498

[56] References Cited

U.S. PATENT DOCUMENTS

| | | | |
|---|---|---|---|
| 3,049,999 | 8/1962 | Sunden | 102/487 |
| 3,726,225 | 4/1973 | Gerber et al. | 102/334 |
| 4,622,899 | 11/1986 | Weber | 102/334 |
| 4,624,186 | 11/1986 | Widera et al. | 102/334 |
| 4,699,063 | 10/1987 | Aschwanden et al. | 102/498 |
| 4,976,201 | 12/1990 | Hamilton | 102/326 |
| 5,499,582 | 3/1996 | Schiessl et al. | 102/334 |

FOREIGN PATENT DOCUMENTS

| | | | |
|---|---|---|---|
| 1185510 | 1/1965 | Germany | 102/334 |
| 1428657 | 2/1969 | Germany | 102/334 |

*Primary Examiner*—Harold J. Tudor
*Attorney, Agent, or Firm*—Darby & Darby

[57] ABSTRACT

A rapid-release smoke hand grenade comprising a manually actuatable igniter head (A) and an active mass member (B), wherein the striker located on the igniter head to initiate the chain of pyrotechnical activity is loaded by means of a safety clip so as to be safe to handle, the smoke-forming means located in the active mass member is in the form of combustible disc-shaped or disc sector-shaped thin leaves (flares) coated with smoke-forming agent based on red phosphorus which practically fill the canister of the active mass member around a capsule for the ignition/bursting unit located therein, the heavy components of this rapid-release smoke hand grenade are held together by connecting elements which are stable when it bursts, and the essential components of the grenade preferably consist of aluminium. In a likewise preferred embodiment the ignition/bursting charge of the ignition/bursting unit consists of a classical detonating charge of aluminium and potassium perchlorate in order to minimise the combustion gases evolved when it reacts.

8 Claims, 1 Drawing Sheet

Fig.
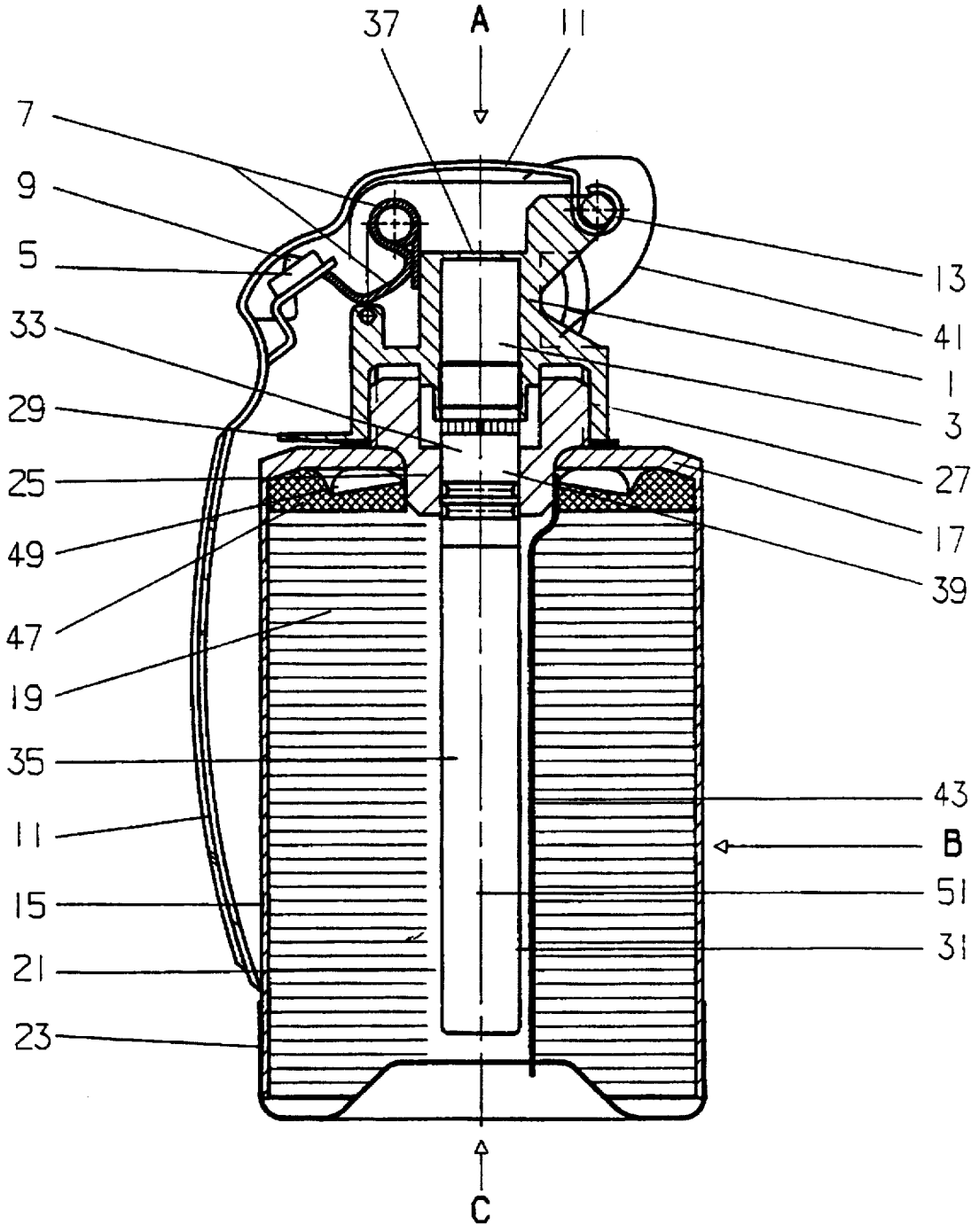

RAPID-RELEASE SMOKE HAND GRENADE

The invention relates to a novel hand grenade in the form of a rapid-release smoke hand grenade.

Hand grenades are military close combat weapons and are used to attack concealed targets which lie within throwing range. Hand grenades usually consist of a casing, an explosive filling and a detonator. Optionally the casing of the hand grenade can be formed so that it splinters a lot. In any event, the explosive filling is caused to explode by ignition.

In addition it is known, for camouflage or to confuse the enemy, to produce a smoke cloud by means of a smoke projectile. Various forms of smoke projectiles are known. Thus for example DE-B 11 85 510 and DE-B 14 28 657 disclose smoke projectiles the smoke charge of which, contained in a propellant container, can be brought into effect by means of a contact head. EP-A 0 046 230 discloses a smoke projectile, the smoke charge of which consists of compacts which have a central opening in them in which an ignition charge is placed and which are stacked in the form of layers in a casing provided with longitudinal predetermined breaking points. For this purpose the smoke-forming agent must be granulated and compressed to compacts. However, the disadvantage of such a compacted material is that the granulate ignites at once and then also reacts rapidly, so that the smoke effect does not persist for very long. In addition the granulate quickly falls to the ground, so that a longer-lasting cloud cannot be generated. While a greater smoke duration can be achieved with compacts, such projectiles constitute a potential danger because of their weight, particularly in the case of the bursting of a hand smoke grenade.

Finally DE-A 28 11 016 discloses projectiles having an electrically actuated contact head and a propellant container in the form of a canister closed by a cap fitted thereon which are fired from a cup discharger, in order to attract and deceive flying objects by infrared radiation.

The smoke generating devices known hither to all had disadvantages associated with them. Either very toxic compounds, for example white phosphorus, were used to generate the smoke, or the smoke cloud formed did not persist for very long. Other smoke-forming substances are used in the hand grenade only as point sources of smoke and have the disadvantage of a prolonged smoke build-up time.

The object of the invention was now to develop a smoke-generating body in the form of a rapid-release smoke hand grenade in which the smoke-forming means very quickly forms a long lasting area of smoke which produces an effect in the infrared region as well as in the visual region and the constituents of which are less toxic than in the case of known smoke-forming means. At the same time the heavier components remaining after the bursting of such a hand grenade should not give rise to any risk of injury to the person throwing the grenade. The same also applies to the smoke-forming material.

This object is achieved in accordance with the invention by means of a rapid-release smoke hand grenade comprising (I) a manually actuatable igniter head comprising a head part having a central bore and including a striker which carries a striker pin, is pivotally mounted on one side of the head part and is actuatable by means of a tension spring, and also comprising a safety clip which is pivotally mounted on the other, opposite side of the head part, is secured by a securing element and when in the secured position holds the striker spring-loaded by means of its spring;

(II) an active mass member comprising a drawn aluminium canister having a base of reinforced construction associated with the head part of the igniter head, a smoke-forming means in the form of thin, light-weight, disc- or disc sector-shaped combustible leaves (flares) coated with smoke-forming agent based on red phosphorus, arranged in the aluminium canister so as to form a passage passing centrally through the interior of the canister, and having a cap tightly closing the aluminium canister at its head portion; and (III) an ignition/bursting unit comprising an insert part connecting the head part of the igniter head to the base of the aluminium canister of the active mass member by means of respective screw threads, and a drawn, thin-walled aluminium capsule, fixed in a central bore of the insert part, which passes through the passage not occupied by the smoke-forming means practically as far as the bottom of the aluminium canister and in which an ignition/bursting charge for ignition of the smoke-forming means and for bursting the aluminium canister by means of an optionally present central detonator cord is located;

wherein the chain of pyrotechnical activity from the striker to the ignition/bursting charge is made up of an igniter cap located in the central bores of the head part and of the insert part and a following ignition delay element, the safety clip is secured to the head part of the igniter head by means of a first connecting element, and the cap closing the aluminium canister is secured to the reinforced base of the aluminium canister by means of a second connecting element.

With the rapid-release smoke hand grenade in accordance with the invention a very stable smoke cloud can be built up in an extremely short time which serves either for camouflage or to confuse the enemy. With the rapid-release smoke hand grenade in accordance with the invention it is possible to build up a smoke cloud with a diameter of up to 10 m within from 1 to 2 seconds, which then remains in the air for up to 2 minutes. The substances it contains and the smoke formed from them are not ecologically toxic. The combustion products are at most slightly toxic, so that only a slight burden is placed on the environment. Furthermore the individual solid parts of the rapid-release smoke hand grenade are connected to one another in such a way that the thrower cannot be injured by them. Again, the smoke particles distributed are so light that they are deposited in an area extending at most 10 m around the bursting point, and no danger to the thrower arises from this either.

In the present active mass member, instead of an aluminium canister, preferably a drawn aluminium canister, it is possible to use a canister of any other metal usually used for this purpose, such as steel sheet, or of a suitable plastics material; in the latter case, particularly on environmental grounds, degradable plastics materials are the first choice.

The igniter head of the rapid-release smoke hand grenade in accordance with the invention is constructed in a manner known per se, with its safety clip being characterized above all by its special shape, and if particular by its elongated clip fork, which prevents accidental release from the securing element located on the head part. Furthermore, accidental separation of the safety clip after actuation of the igniter head, and thus danger to the thrower arising from this, is prevented in accordance with the invention by the safety clip being secured to the head part of the igniter head by a connecting element, for which purpose this connecting element preferably consists of a steel cable, a steel wire or a steel clip secured to the respective parts to be connected. The head part of the igniter head can be made of any material usually employed for this purpose. In particular it may consist of aluminium and is preferably made by pressure die casting. The igniter cap located in the central bore of the head part is a component conventionally used in the art, the active constituents of which are initiated when it is struck by the striker via the striker pin carried thereon, leading to immediate ignition of the ignition delay element which is actively linked to it and is located in the insert part of the ignition/bursting unit. This striker and its individual parts are likewise of conventional construction.

The preferred aluminium canister of the active mass member is preferably produced by deep drawing, extrusion pressing or pressure die casting. This makes it simple to manufacture a compact canister having a reinforced base, which is needed both for reasons of strength and also for secure fitting and assembly of the other components of the rapid-release smoke hand grenade which have to be anchored in the base or fitted round it. The aluminium canister, after fitting the ignition/bursting unit in the central bore of its reinforced base, which is preferably done by means of a screw thread, is provided from its open bottom with the parts to be fitted inside it. These include, inter alia, the spacer ring which is preferably present and lies against the base and is loaded by a spring, in particular a snap ring. They also include the connecting element which is preferably also present, when this is to be fitted to run inside the aluminium canister in the annular gap between the thin-walled aluminium capsule of the ignition/bursting unit and the smoke-forming agent arranged around this. Of course, in such case this connecting element can be first fixed to the base of the aluminium canister. After that the smoke-forming means present in the form of thin combustible light-weight leaves (flares) shaped as discs or sectors of discs are introduced into the aluminium canister. After filling the aluminium Canister completely with the flares forming the smoke-forming means this canister is tightly closed with a cap. This can be done by conventional means, preferably by placing an adhesive between the inner circumference of the cap and the associated outer circumference of the aluminium canister. After fitting the cap on the aluminium canister it is also necessary to secure to the bottom of the cap the connecting element which in a preferred embodiment is present in the annular gap, using means which result in a secure connection of the reinforced base of the aluminium canister to its cap.

This connecting element may, for example, consist of a securely fixed steel cable, steel wire or steel clip, care being taken, preferably by making it rather too long, that this element can already be fixed securely to the cap before the labour on the active mass member and before the cap is finally put on. Instead of this such a connecting element can also be a so-called "sieve tube" (perforated liner), such as is commonly used to secure the bottom of such canisters to their respective caps. For this purpose, a perforated liner (to allow problem-free passage of the combustion gases)is simply placed around the respective capsule of the ignition/bursting unit, namely in an unoccupied passage, and fixed to the parts to be connected in a suitable manner, for example by screwing.

The assembly comprising a spacer ring loaded by a spring, preferably a snap ring, fitted between the reinforced base and the adjacent uppermost layer of the smoke-forming means, which is again present in a preferred embodiment, serves to compensate for dimensional tolerances and above all to ensure that the smoke-forming means is thereby fixed in the aluminium canister in the form of a compact body.

In a preferred embodiment the aluminium canister of the active mass member is provided with radially or, better, longitudinally extending predetermined breaking points in its cylindrical surface, these advantageously being in the form of longitudinal grooves in the cylindrical surface of the aluminium canister which can be formed by stamping during the production of the aluminium canister. These predetermined breaking points facilitate the break-up of the aluminium canister and at the same time make possible a clean all round distribution of the smoke-forming means present in the aluminium canister, with the result that the desired large-area and clean smoke cloud is formed which continues to float for a relatively long time and to be fed by the burning smoke-forming means.

As substrates for the thin leaves which form the smoke-forming means, a very wide variety of plastics materials as well as uncoated or coated paper are suitable. The latter is preferred, since the former normally always contains some water, so that a premature reaction with the red phosphorus which constitutes the basis of the smoke-forming agent could occur. The pyrotechnic active mass to be applied to the carrier contains red phosphorus as the main active material. It preferably consists of about 70 to 80% by weight of pyrotechnic mass, including red phosphorus, and about 20 to 30 wt. % of a binder, which is preferably a pasty polyvinyl chloride. This pyrotechnic mass can also contain other usual additives, for example a proportion of magnesium in order to further accelerate the smoke formation.

The combustible disc-shaped or disc sector-shaped thin leaves (particles forming segments of a circle, which are optionally connected together by bridges or webs and hence represent disc-shaped particles) have an outer circumference corresponding approximately to the internal diameter of the aluminium canister and an inner circumference corresponding approximately to the thin-walled aluminium capsule of the ignition/bursting unit to be inserted in the central passage which is formed. Admittedly there is preferably a relatively narrow annular groove, or at least a small passage, left free in which the connecting element which is preferably provided between the base of the aluminium canister and its cap can be accommodated. The special form of the smoke-forming means has the advantage that the smoke-forming means can be arranged in the aluminium canister in a very economical and tightly-packed manner in which, after being ignited, these leaves burn away relatively slowly from the rim to the centre. The leaves thereby remain floating in the air for a relatively long time and—in contrast to the combustion of granular smoke-forming meanss—also retain their smoke-forming action for a relatively long time. Of course, the substrate of the smoke-forming means can be coated on one side, or preferably on both sides, with smoke-forming agent.

The third important component of the rapid-release smoke hand grenade of the invention is an ignition/bursting unit, the insert part of which is preferably fitted in the central bore of the reinforced base of the aluminium canister in a secure and tightly sealing manner, preferably by means of a screw thread. The head portion of this insert part is secured by suitable means, again preferably a screw thread, to the head part of the ignition head. If necessary the individual components are furthermore sealed from one another in a gastight manner. In the central bore of the insert part a thin-walled, aluminium capsule is fitted which extends through practically the whole of the active mass member. The insert part of the ignition/bursting unit can again consist of any material conventionally used for the purpose, and is preferably made from aluminium. The thin-walled aluminium capsule of the ignition/bursting unit can contain an ignition/bursting charge of the usual kind, but the active constituent of this charge is preferably a classical aluminium/potassium perchlorate ($Al/KClO_4$) detonating charge, since such a charge is far less toxic than a charge based on magnesium and barium nitrate ($Mg/Ba(NO_3)_2$). The chain of activity and consequently the ignition path from the firing cap located in the head part of the igniter head to the ignition/bursting charge in the thin-walled aluminium capsule is formed through an ignition delay element fitted in the central bore of the insert part of the ignition/bursting unit. This serves, as a result of its predetermined delay, to ensure that once mechanical initiation has taken place the rapid-release smoke hand grenade of the invention can only deploy its effect, with bursting of the aluminium canister and ignition and delivery of the smoke-forming means, after a desired time, and consequently also a desired throwing distance. At the same time the ignition delay element allows the thrower a certain amount of time to throw the grenade and, if necessary, also to take himself to a place of safety. For more rapid ignition and more thorough reaction of the ignition/bursting charge contained in the aluminium capsule, a detonator cord is preferably also located in the charge. Instead of this, particles of more strongly active material can optionally also be randomly distributed in the ignition/bursting charge, thereby again if necessary bringing about rapid ignition and thorough reaction of the ignition/bursting charge proper. The predetermined time within which the ignition delay element reacts through and then ignites the ignition/bursting charge amounts to only a few seconds and may, for example, be in the range from 1 to 8 seconds.

The use of aluminium as material of construction for the important components of the rapid-release smoke hand grenade of the invention affords, beside the advantage of the greater ease of manufacture of such articles, the further benefit that this material has the corrosion resistance to and compatibility with most pyrotechnical charges that is desired for such devices, so that there is then no need for special corrosion protection measures. In addition, in such a case the fragments formed on bursting are also so light that they do not fly far and cannot cause any injury.

Before throwing, the rapid-release smoke hand grenade of the invention is grasped by the throwing hand so that the safety clip is held fast. With the other hand the securing element is released. The safety clip is then still only held fast by the throwing hand. When the grenade is now thrown, the spring-loaded striker can then force the safety clip away so that its striker pin can strike the firing cap fitted in the head portion of the igniter head and thereby initiate the charge contained therein and then set the whole chain of activity in motion. After the predetermined delay time the ignition/bursting charge contained in the ignition/bursting unit is ignited, the thin-walled aluminium capsule is burst and the smoke-forming means surrounding this is thereby set alight. At the same time the wall of the aluminium canister is burst apart and the burning smoke-forming leaves are ejected into the surroundings with the formation of a clean, floating cloud. The grenade thrower is protected from mechanical injury above all by the fact that the more massive parts of the rapid-release smoke hand grenade of the invention are connected by corresponding securing elements and cannot fly apart.

The invention will now be described with reference to a single FIGURE, which shows a longitudinal section through a rapid-release smoke hand grenade in accordance with the invention.

In detail, the FIGURE shows an igniter head A which can be actuated manually by means of a safety clip 11. The safety clip 11 is secured to the head part 1 of the igniter head A by means of a securing element 1. Further, a striker 5 carrying a striker pin 9 is secured to the head part 1 approximately opposite the safety element 13 in an assembly that is pivotable by means of the tension spring 7 and its mounting, the striker being held in the safe condition by the safety clip 11 under spring loading. The head part 1 has a central bore 3, in which is located the upper end, associated with the striker 5, of an igniter cap 37 which contains a conventional igniter charge which can be initiated by impact. The safety clip 11 is secured by a connecting element 41 (in the present case a steel wire) to the head part 1 of the igniter head, in order in this manner to prevent the safety clip 11 from coming loose from the head part and flying away separately after the throwing and the reaction of the present rapid-release smoke hand grenade. In the head part 1 there is also a screw thread 27 by which the igniter head can be secured firmly to an ignition/bursting unit C and, via the latter, also to an active mass member B.

The FIGURE also shows in detail an active mass member B comprising first of all a drawn aluminium canister 15. In the central bore of the reinforced base 17 of this canister, which is preferably provided with a screw thread 29, the ignition/bursting unit C, which will be described in detail later, is fitted in a gastight sealing manner. Corresponding to a preferred embodiment there is fitted in the interior of the aluminium canister 15, in the immediate vicinity of its reinforced base 17, a spacer ring 47 which is pressure loaded by a spring 49, which in the form illustrated is a snap ring.

In the central bore of the insert part 25 of the ignition/bursting unit C is fitted, likewise in a gastight sealing manner, the thin-walled aluminium capsule 31. The thin-walled aluminium capsule 31 extends axially practically through the whole of the aluminium canister 15 and is completely filled with an ignition/bursting charge 35, which in the preferred embodiment is a classical detonation charge of aluminium and potassium perchlorate, especially since this is substantially less toxic than the ignition/bursting charges otherwise conventionally used, which involve a mixture of magnesium and barium nitrate, which is classed as toxic. Fitted in the central bore 33 of the insert part 25 of the ignition/bursting unit C is the ignition delay element 39, the active mass of which provides the desired delay, for example a standard delay of 3.5±0.5 seconds. The aluminium canister 15 is completely filled (except for the formation of a passage 21 or else only a recess to guide a connecting element 43) with the smsmoke-forming means-forming agent 19 in the form of coated combustible disc-shaped, and in the preferred embodiment disc sector-shaped, leaves (flares). In the preferred embodiment these are coated on both sides with a smoke-forming agent based on red phosphorus, this coating preferably consisting of about 70 to 80% by wt. of a pyrotechnic mass-comprising red phosphorus and about 20 to 30% by wt. of binder.

The aluminium canister 15 of the active mass member B is securely connected at its originally open end to a cap 23, this connection consisting in the preferred embodiment of an adhesive (not shown) disposed between the inner circumference of the cap 23 and the associated part of the aluminium canister 15. The reinforced base 17 of the aluminium canister 15 is secured to the cap 23 by a connecting element 43, which in the preferred embodiment shown is a steel wire which is guided in an annular groove kept clear in the passage 21 between the thin-walled aluminium capsule 31 and the smoke-forming means 19 or as an alternative simply a longitudinal notch formed therein. Apart from this, the spacer ring 47 loaded by the spring 49 serves, as already mentioned, to compensate for dimensional tolerances and any residual volume and to hold the combustible, disc-shaped or disc sector-shaped thin leaves (flares) forming the smoke-forming means 19 practically solidly together.

The manner in which the rapid-release smoke hand grenade in accordance with the invention functions is well known to those skilled in the art and has already been briefly described. The invention is of course not restricted to the particular embodiments mentioned, but also extends to modifications falling within the scope of the knowledge of those skilled in the art insofar as use is made therein of the essential elements of the invention.

We claim:

1. A rapid-release smoke hand grenade, comprising (I) a manually actuatable igniter head (A) comprising a head part (1) having a central bore (3) and including a striker (5) which carries a striker pin (9), is pivotally mounted on one side of the head part (1) and is actuatable by means of a tension spring (7), and also comprising a safety clip (11) which is pivotally mounted on the other, opposite side of the head part (1), is secured by a safety element (13) and when in the secured position holds the striker (5) spring-loaded by means of its spring (7);

(II) an active mass member (B) comprising a drawn aluminium canister (15) having a base (17) of reinforced construction associated with the head part (1) of the igniter head, a smoke-forming means (19) in the form of thin, lightweight, disc- or disc sector-shaped combustible leaves coated with smoke-forming agent based on red phosphorus, arranged in the aluminium canister (15) so as to form a passage (21) passing centrally through the interior of the canister, and having a cap (23) tightly closing the aluminium canister (15) at its head portion; and (III) an ignition/bursting unit (C) comprising an insert part (25) connecting the head part (1) of the igniter heat (A) to the base of the aluminium canister (15) of the active mass member (B) by means of respective screw threads (27, 29), and a drawn, thin-walled aluminium capsule (31), fixed in a central bore (33) of the insert part (25), which passes through the passage (21) not occupied by the smoke-forming means (19) practically as far as the bottom of the aluminium canister (15) and in which an ignition/bursting charge (35) for ignition of the smoke-forming means (19) and for bursting the aluminium canister (15) is located;

wherein the chain of pyrotechnical activity from the striker (5) to the ignition/bursting charge (35) is made up of an igniter cap (37) located in the central bores (3, 33) of the head part (1) and of the insert part (25) and a following ignition delay element (39), the safety clip (11) is secured to the head part (1) of the igniter head (A) by means of a first connecting element (41), and the cap (23) closing the aluminium canister (15) is secured to the reinforced base (17) of the aluminium canister by means of a second connecting element (43).

2. A rapid-release smoke hand grenade according to claim 1, characterised in that at least one of the first connecting element (41) and the second connecting element (43) is selected from the group which consists of a steel cable, steel wire, steel clip and perforated liner securely fixed to the respective parts to be connected.

3. A rapid-release smoke hand grenade according to claim 1, characterised in that the second connecting element (43) is arranged to run in an annular gap formed by the passage (21) between the thin-walled aluminium capsule (31) and the smoke-forming means (19).

4. A rapid-release smoke hand grenade according to claim 1, characterised in that the aluminium canister (15) of the active mass member (B) is provided with radially or longitudinally extending predetermined breaking points in its cylindrical surface.

5. A rapid-release smoke hand grenade according to claim 4, characterised in that the predetermined breaking points present in the aluminium canister (15) are in the form of longitudinal grooves in its cylindrical surface.

6. A rapid-release smoke hand grenade according to claim 1, characterised in that the smoke-forming agent located on the smoke-forming means (19) consists of about 70 to 80% by wt. of a pyrotechnic mass comprising red phosphorus and about 20 to 30% by wt. of binder.

7. A rapid-release smoke hand grenade according to claim 1, characterised in that the ignition/bursting charge (35) contains aluminium and potassium perchlorate as active ingredients.

8. A rapid-release smoke hand grenade according to claim 1, which also comprises a central detonator cord (51) for igniting the ignition/bursting charge (35).

* * * * *